United States Patent [19]

Cooper et al.

[11] Patent Number: 4,893,342

[45] Date of Patent: Jan. 9, 1990

[54] HEAD DIFFRACTION COMPENSATED STEREO SYSTEM

[76] Inventors: Duane H. Cooper, 918 W. Daniel St., Champaign, Ill. 61821; Jerald L. Bauck, 1007 W. Clark #4, Urbana, Ill. 61801

[21] Appl. No.: 109,197

[22] Filed: Oct. 15, 1987

[51] Int. Cl.[4] ..... H04R 5/027

[52] U.S. Cl. ..... 381/26

[58] Field of Search ..... 381/1, 17, 18, 26, 103

[56] References Cited

U.S. PATENT DOCUMENTS

| | | | |
|---|---|---|---|
| 4,119,798 | 10/1978 | Iwahara | 381/26 |
| 4,356,349 | 10/1982 | Robinson | 381/1 |
| 4,388,494 | 6/1983 | Schöne et al. | 381/26 |
| 4,503,554 | 3/1985 | Davis | 381/1 |
| 4,566,119 | 1/1986 | Peters | 381/103 |
| 4,731,848 | 3/1988 | Kendall et al. . | |
| 4,748,669 | 5/1988 | Klayman . | |
| 4,819,269 | 4/1989 | Klayman . | |

*Primary Examiner*—Forester W. Isen

*Attorney, Agent, or Firm*—Welsh & Katz, Ltd.

[57] ABSTRACT

A stereo audio processing system for a stereo audio signal processing reproduction that provides improved source imaging and simulation of desired listening environment acoustics while retaining relative independence of listener movement. The system first utilizes a synthetic or artificial head microphone pickup and utilizes the results as inputs to a cross-talk cancellation and naturalization compensation circuit utilizing minimum phase filter circuits to adapt the head diffraction compensated signals for use as loudspeaker signals. The system provides for head diffraction compensation including cross-coupling while permitting listener movement by limiting the cross-talk cancellation and diffraction compensation to frequencies substantially below approximately ten kilohertz.

20 Claims, 13 Drawing Sheets

152
154
151
155
156
-1
158
160
150
162
Δ
164
Σ
166
167
168
-1
170
172
LF
174
RF
176
Rθ
Lθ
2a
Ø

52
64
66
54
50
58
62
RF
74
S'G
78
A'F
82
76
A'F
80
72
S'G
56
60
LF
84
Rθ
Lθ
Ø

102
114
116
140
120
122
124
110
112
121
C
C
G
G
F
F
123
126
128
+
+
130
100
132
134
1/S
1/(1-C²)
1/(1-C²)
1/S
136
138
140
LF
142
RF
S
A
A
S
143
Le
Re
145
144

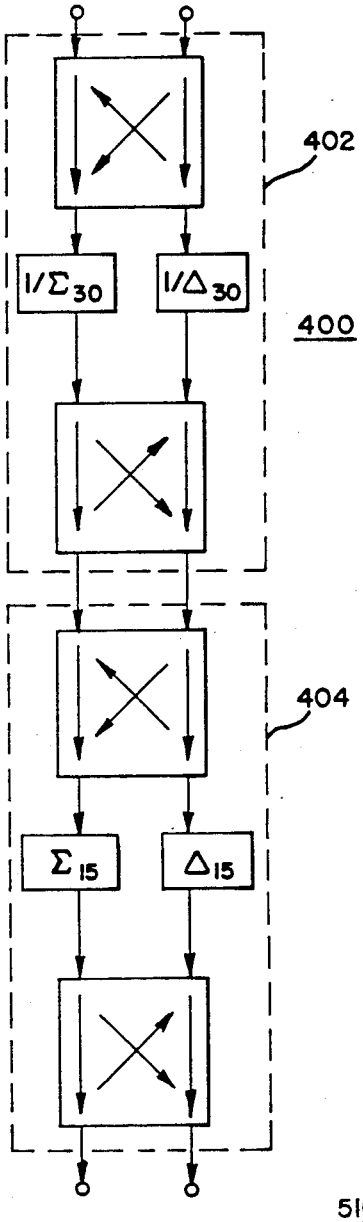
FIG. 10a
FIG. 10b
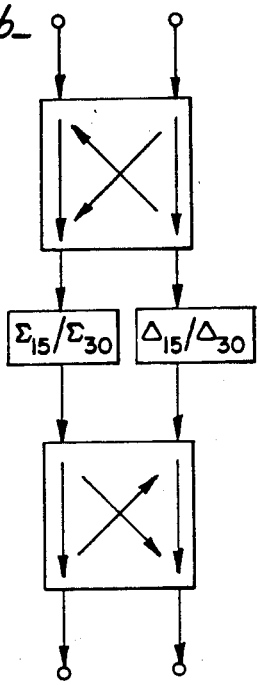
FIG. 11
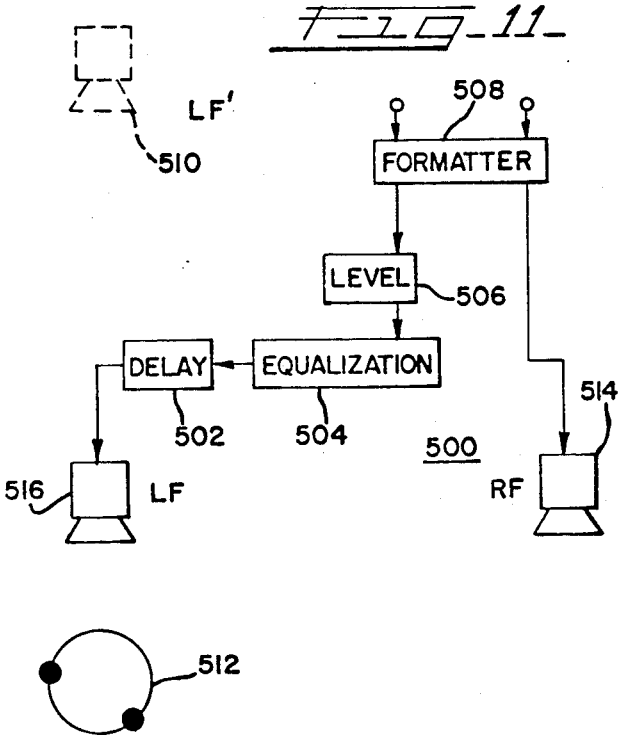

HEAD DIFFRACTION COMPENSATED STEREO SYSTEM

BACKGROUND OF THE INVENTION

This invention relates generally to the field of audio-signal processing and more particularly to a system for stereo audio-signal processing and stereo sound reproduction incorporating head-diffraction compensation, which provides improved sound-source imaging and accurate perception of desired source-environment acoustics while maintaining relative insensitivity to listener position and movement.

There is a wide variety of prior-art stereo systems, most of which fall within three general categories or types of systems. The first type of stereo system utilizes two omnidirectional microphones usually spaced approximately one half to two meters apart and two loudspeakers placed in front of the listener towards his left and right sides in correspondence one for one with the microphones. The signal from each microphone is amplified and transmitted, often via a recording, through another amplifier to excite its corresponding loudspeaker. The one-for-one correspondence is such that sound sources toward the left side of the pair of microphones are heard predominantly in the left loudspeaker and right sounds in the right. For a multiplicity of sources spread before the microphones, the listener has the impression of a multiplicity of sounds spread before him in the space between the two speakers, although the placement of each source is only approximately conveyed, the images tending to be ague and to cluster around loudspeaker locations.

The second general type of stereo system utilizes two unidirectional microphones spaced as closely as possible, and turned at some angle towards the left for the leftward one and towards the right for the rightward one. The reproduction of the signals is accomplished using a left and right loudspeaker placed in front of the listener with a one-for-one correspondence with the microphones. There is very little difference in timing for the emission of sounds from the loudspeakers compared to the first type of stereo system, but a much more significant difference in loudness because of the directional properties of the angled microphones. Moreover, such difference in loudness translates to a difference in time of arrival, at least for long wavelengths, at the ears of the listener. This is the primary cue at low frequencies upon which human hearing relies for sensing the direction of source. At higher frequencies (i.e., above 600 Hz), directional hearing relies more upon loudness differences at the ears, so that high frequency sounds in such stereo systems have thus given the impression of tending to be more localized close to the loudspeaker positions rather than spread as the original sources had been.

The third general type of stereo system synthesizes an array of stereo sources, by means of electrical dividing networks, whereby each source is represented by a single electrical signal that is additively mixed in predetermined proportions into each of the two stereo loudspeaker channels. The proportion is determined by the angular position to be allocated for each source. The loudspeaker signals have essentially the same characteristic as those of the second type of stereo system.

Based upon these three general types of stereo systems, there are many variants. For example, the first type of system may use more than two microphones and some of these may be unidirectional or even bidirectional, and a mixing means as used in the third type of system may be used to allocate them in various proportions between the loudspeaker channels. Similarly, a system may be primarily of the second type of stereo system and may use a few further microphones placed closed to certain sources for purposes of emphasis with signals to be proportioned between the channels. Another variant of the second type of stereo system makes use of a moderate spacing, for example 150 mm, between the microphones with the left angled microphone spaced to the left, and the right-angle microphone spaced to the right. Another variant uses one omnidirectional microphone coincident, as nearly as possible, with a bidirectional microphone. This is the basic form of the MS (middle-side) microphone technique, in which the sum and difference of the two signals are substantially the same as the individual signals from the usual dual-angled microphones of the second type of system.

Each of these systems has its advantages and disadvantages and tends to be favored and disfavored according to the desires of the user and according to the circumstances of use. Each fails to provide localization cues at frequencies above approximately 600 Hz. Many of the variants represent efforts to counter the disadvantages of a particular system, e.g., to improve the impression of uniform spread, to more clearly emulate the sound imaging, to improve the impression of "space" and "air," etc. Nevertheless, none of these systems adequately reckons with the effects upon a soundwave of propagation in the space close to the head in order to reach the ear canal. This head diffraction substantially alters both the magnitude and phase of the soundwave, and causes each of these characteristics to be altered in a frequency-dependent manner.

The use of head-diffraction compensation to make greatly improved stereo sound in a loudspeaker system was demonstrated by M. R. Schroeder and B. S. Atal to emulate the sounds of various concert halls with extraordinary accuracy. Schroeder measured the values of head-related transfer functions for an artificial or "dummy" head (i.e., a physical replica of a head mounted on a fully-clothed manikin) that had microphones placed in its ear canals. This information was used to process two-channel sound recorded using a second artificial head (i.e., to process a binaural recording). Since each ear hears both speakers, the system used crosstalk cancellation to cancel the effects of sound traveling around the listener's head to the opposite ear. Crosstalk cancellation was performed over the entire audio spectrum (i.e., 20 Hz to 20 KHz)

For a listener whose head reasonably well matched the characteristics of the manikin head, the result was a great improvement in characteristics such as spread, sound-image localization and space impression. However, the listener had to be positioned in an exact "sweet spot" and if the listener turned his head more than approximately ten degrees, or moved more than approximately 6 inches the illusion was destroyed. Thus, the system was far too sensitive to listener position and movement to be utilized as a practical stereo system.

It is accordingly an object of the invention to provide a novel stereo system which provides enhanced sound-imaging localization which is relatively independent of listener position and movement.

It is another object of the invention to provide a novel stereo system for adapting sound signals utilizing head-diffraction functions, and crosscoupling with filtering to substantially limit the frequency range of such processing to substantially below approximately ten kilohertz to provide enhanced source imaging and accurate perception of simulated acoustics in such frequency range.

It is a further object of the invention to provide means of utilizing head-diffraction functions so that they may be simulated by means of simple electrical analog or digital filters, in most cases of the minimum-phase type.

Briefly, according to one embodiment of the invention, an audio processing system is provided including means for providing two channels of audio signals having head-related transfer functions imposed thereon. In addition, means are provided for cross-talk cancellation, and means for naturalization compensation to correct for the cross-talk cancellation and for propagation path distortions including filtering means for substantially limiting the cross-talk cancellation and naturalization compensation to frequencies substantially below ten kilohertz. In another embodiment, means are provided for simulating the two channels of audio signals from a single channel of audio signals by processing the single channel of audio signals to generate synthetic head signals for each ear, respectively utilizing head diffraction compensation for a selected set of synthetic source bearing angles. According to another aspect of the invention, a reformatted is provided for reformatting audio signals generated for reproduction at a first set of stereo speaker bearing angles to a format for reproduction at a second selected set of stereo speaker bearing angles.

BRIEF DESCRIPTION TO THE DRAWINGS

The invention, together with further objects and advantages thereof, may be understood by reference to the following description taken in conjunction with the accompanying drawings.

Figure 1C:
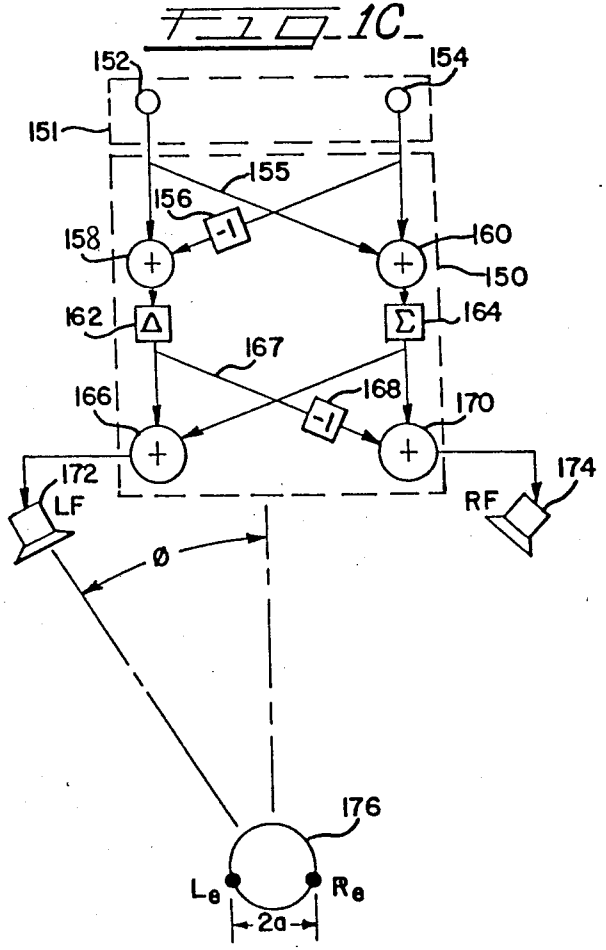
FIG. 1C is a generalized block diagram illustrating another specific embodiment of a stereo audio processing system according to the invention.
Figure 2B:
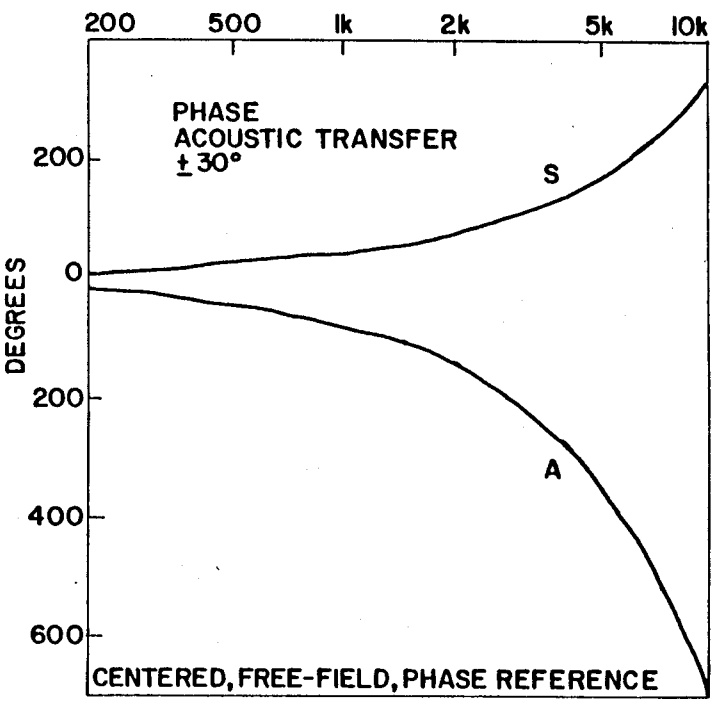
FIG. 2B is a set of phase-(degrees)-versus-frequency-(log scale) response curves of the transfer characteristics from a loudspeaker at 30° to an ear on the same side, curve S, and to the alternate ear, curve A, used in explaining the invention.
Figure 2A:
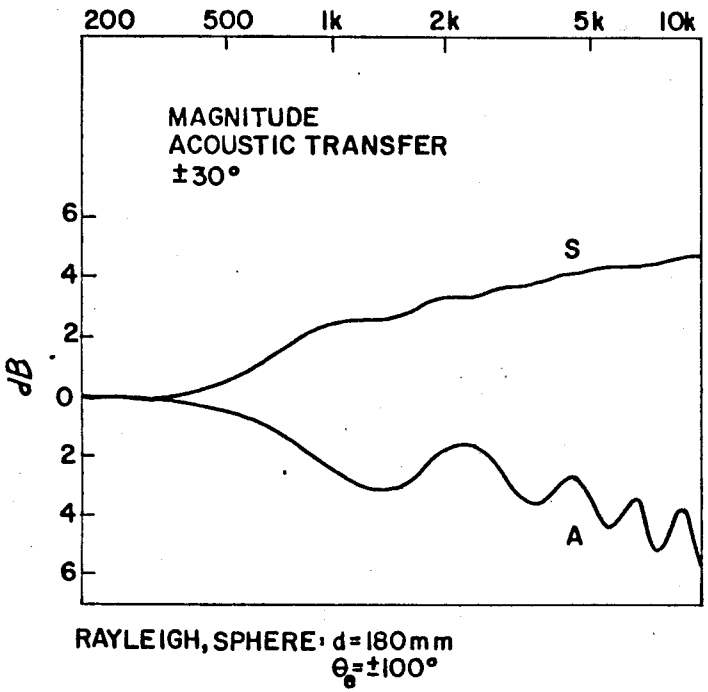
FIG. 2A is a set of magnitude (dB)-versus-frequency-(log scale) response curves of the transfer characteristics from a loudspeaker at 30° to an ear on the same side, curve, S, and to the alternate ear, curve A, used in explaining the invention.
Figure 2D:
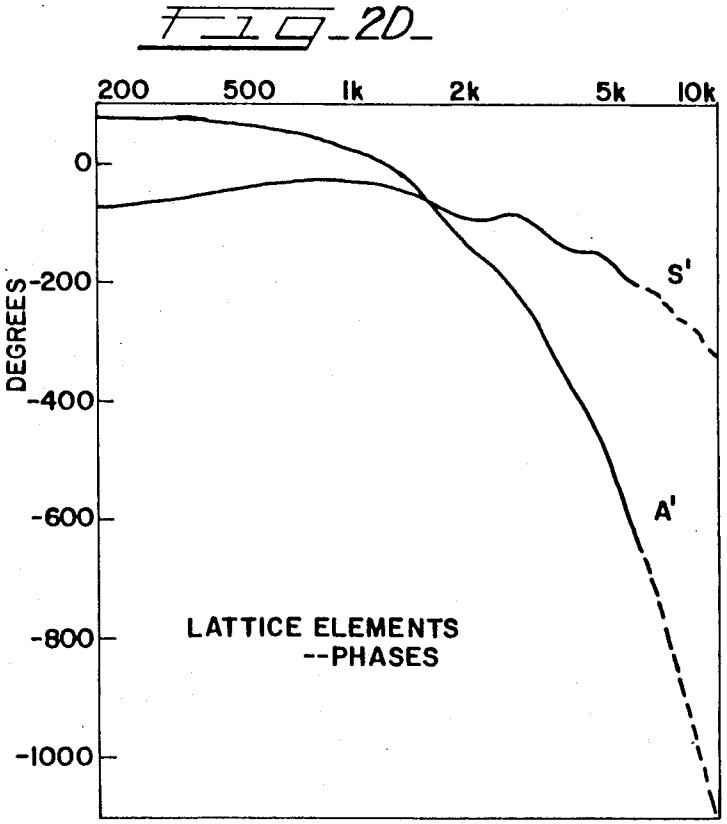
FIG. 2D is a set of phase-(degrees)-versus-frequency-(log scale) response curves of the transfer characteristics of the filters shown in FIG. 1A, filters S' and A', but omitting the phase consequences of the factors G and F, and showing in dashed line the frequency region in which the magnitude modifications are made, used in explaining of the invention.
Figure 2C:
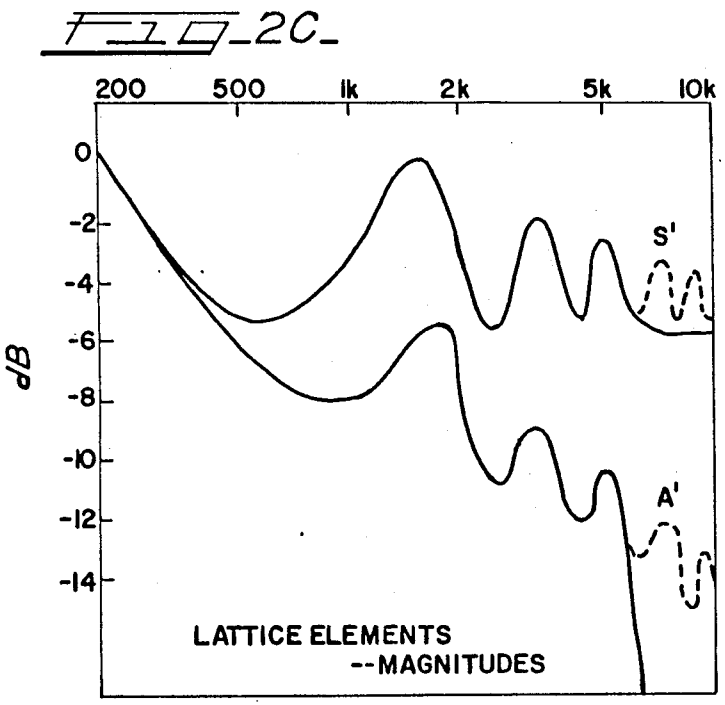
FIG. 2C is a set of magnitude-(dB)-versus-frequency-(log scale) response curves of the transfer characteristics of the filters shown in FIG. 1A, filters S' and A', continuing in dashed line, and as modified by the factors G and F, respectively, continuing in solid line, used in explaining the invention.
Figure 3B:
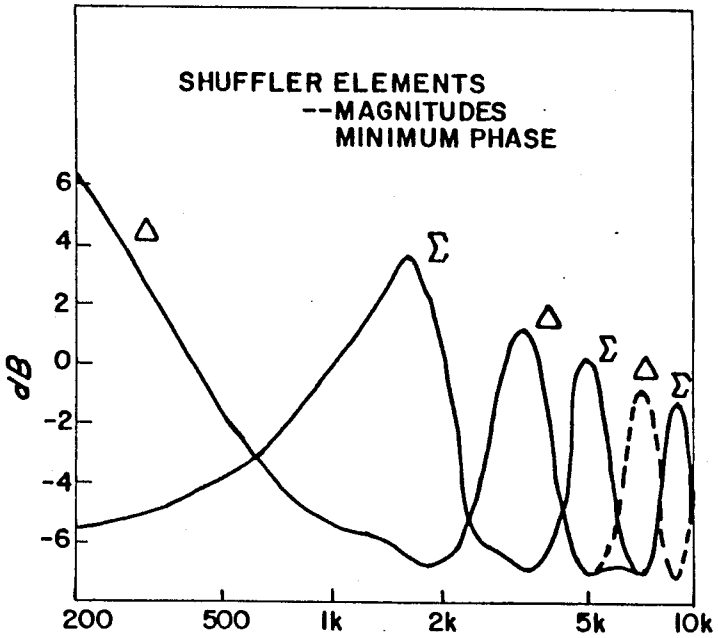
Figure 3A:
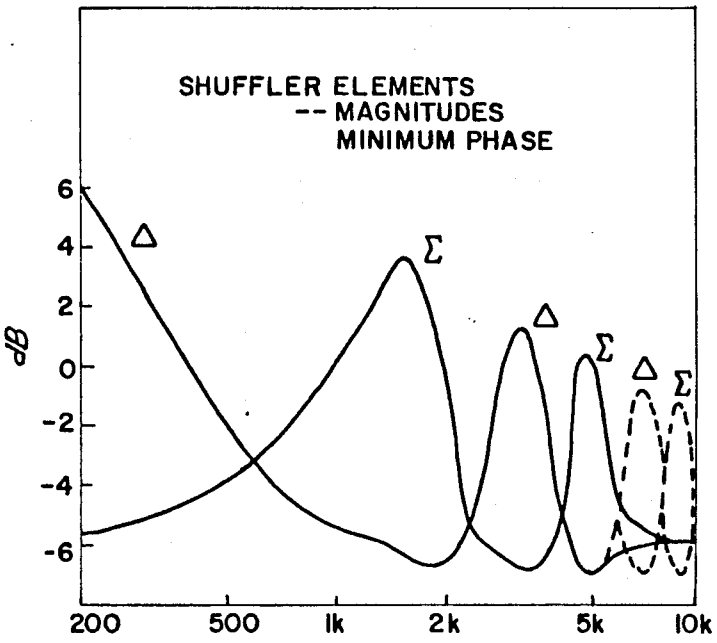

FIG. 3A is a set of magnitude-(dB)-versus-frequency-(log scale) response curves of the transfer characteristics of a specific embodiment of the filters shown in FIG. 1C, filters Delta (Δ) and Sigma (Σ) continuing in dashed line, and as modified in their synthesis, continuing in solid line, modifications alternatively accounting for the modifications represented by the filter factors G and F, as shown in FIG. 2C, used in explaining the invention.

FIG. 3B is a set of magnitude-(db)-versus-frequency-(log scale) response curves of the transfer characteristics of a specific embodiment of the filters shown in FIG. 1C, having characteristics similar to those in FIG. 3A, showing first alternative modifications, used in explaining the invention.

Figure 1A:
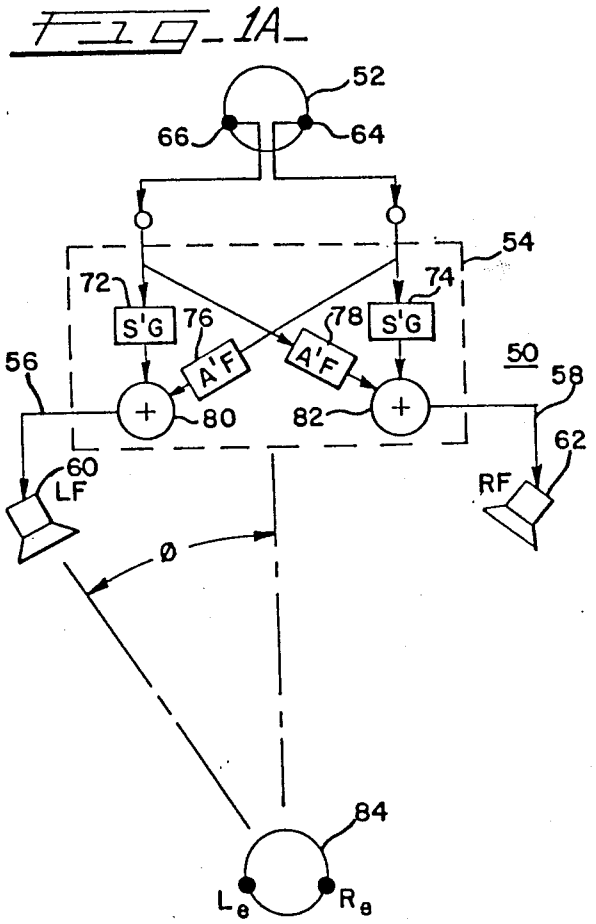
FIG. 1A is a generalized block diagram illustrating a specific embodiment of a stereo audio processing system according to the invention.
Figure 3C:
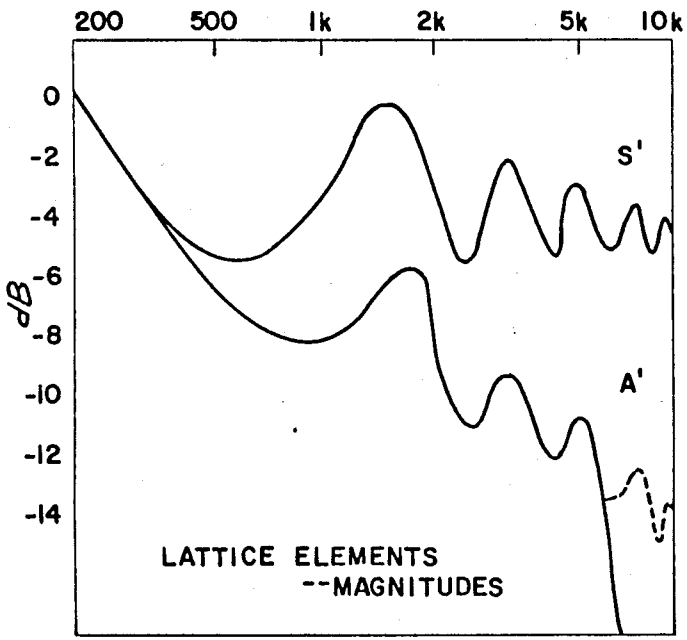

FIG. 3C is a set of magnitude-(dC)-versus frequency-(log scale) response curves of the transfer characteristics of the specific embodiment of the filters shown in FIG. 1A, having characteristics similar to those shown in FIG. 2C, showing the modifications therein that are the consequences of the alternative modifications shown in FIG. 3B, used in explaining the invention.

Figure 4A:
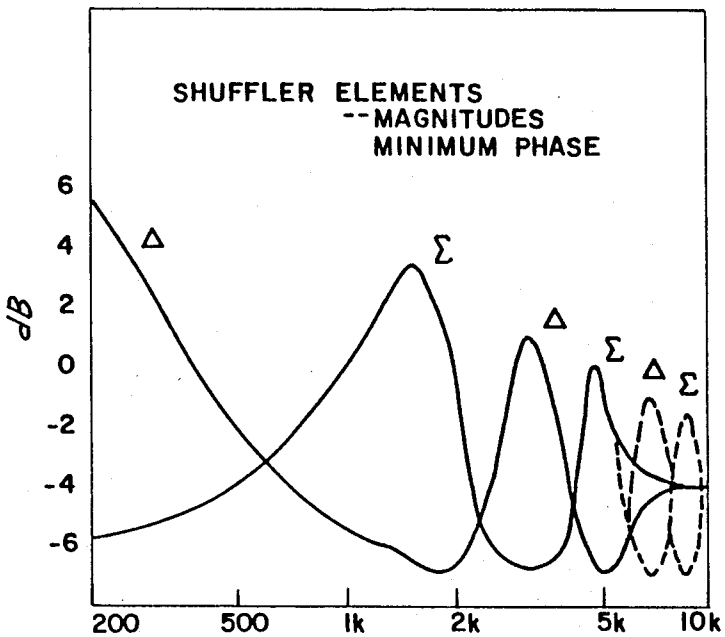

FIG. 4A is a set of magnitude-(dB)-versus-frequency-(log scale) response curves of the transfer characteristics of a specific embodiment of the filters shown in FIG. 1C, having characteristics similar to those shown in FIG. 3A, showing second alternative modifications, used in explaining the invention.

Figure 4C:
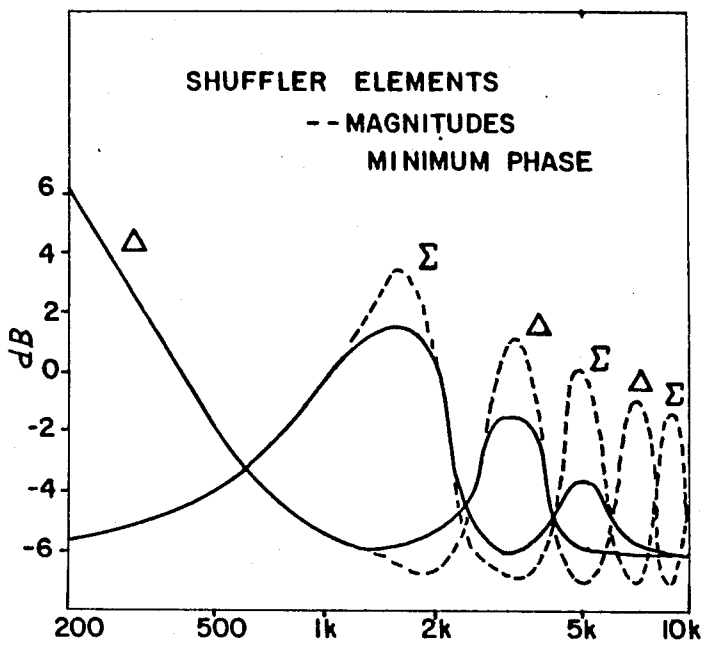
Figure 4B:
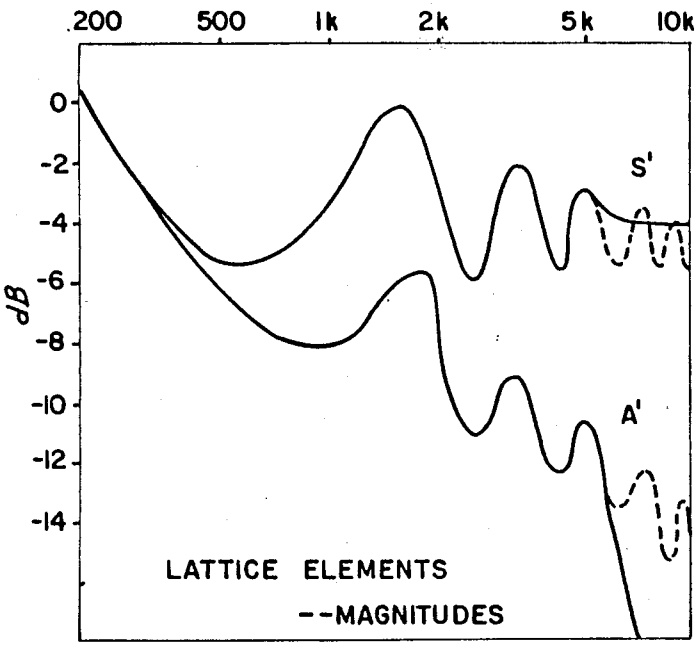

FIG. 4B is a set of magnitude-(dB)-versus-frequency-(log scale) response curves of the transfer characteristics of a specific embodiment of the filters shown in FIG. 1A, having characteristics similar to those shown in FIG. 2C, showing the modifications therein that are the consequences of the alternative modifications shown in FIG. 4A,. used in explaining the invention.

FIG. 4C is a set of magnitude-(dB)-versus-frequency-(log scale) response curves of the transfer characteristics of a specific embodiment of the filters shown in FIG. 1C, having characteristics similar to those shown in FIG. 3A, showing third alternative modifications, used in explaining the invention.

Figure 5A:
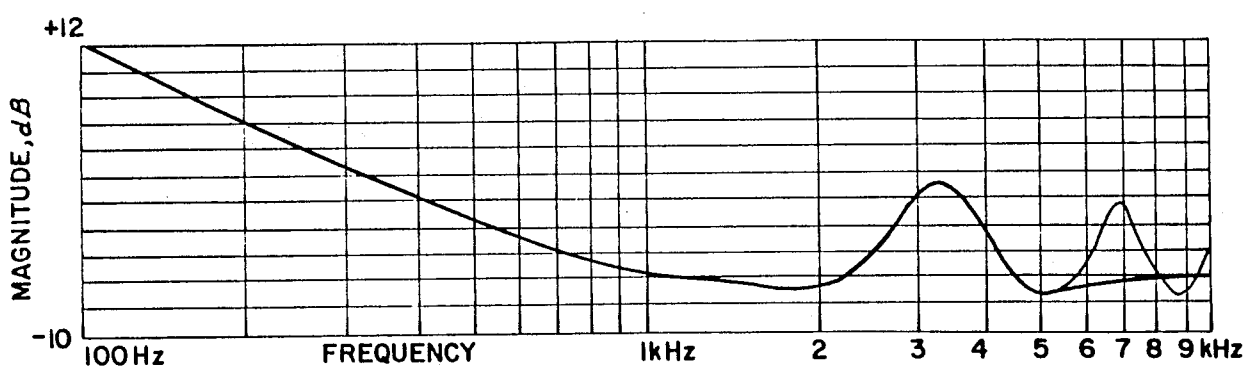

FIG. 5A is a set of magnitude-(dB)-versus-frequency-(log scale) computer-generated response curves of the transfer characteristics of the Delta filter shown in FIG. 1C, having characteristics similar to those shown for the Delta filter in FIG. 3A, showing in dashed line the diffraction-computation specification, and in solid line the approximation thereto, with modification, computed for the synthesis via a specific sequence of biquadratic filter, elements, used in explaining the invention.

Figure 5B:
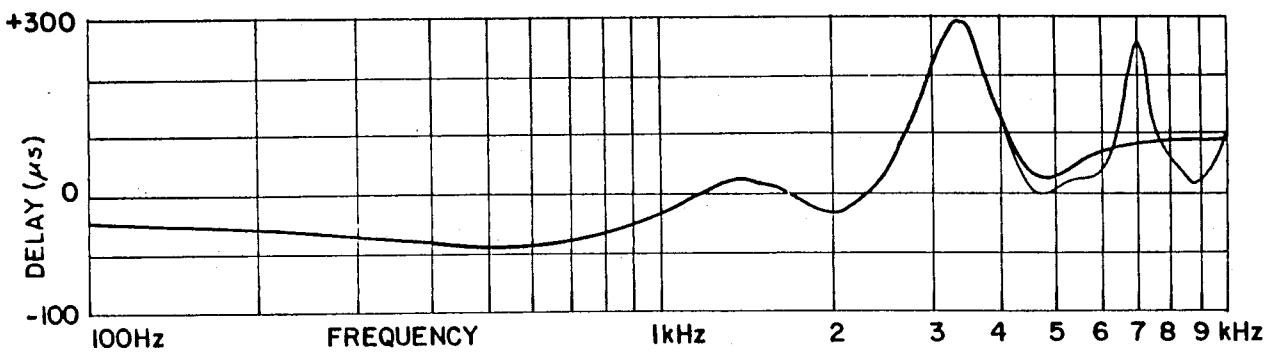

FIG. 5B is a set of delay-(vs)-versus-frequency-(log scale) computer-generated response curves of the transfer characteristics consequent to the magnitude characteristics of FIG. 5A, with a biquadratic synthesis curve (minimum phase) shown in solid line, used in explaining the invention.

Figure 5C:
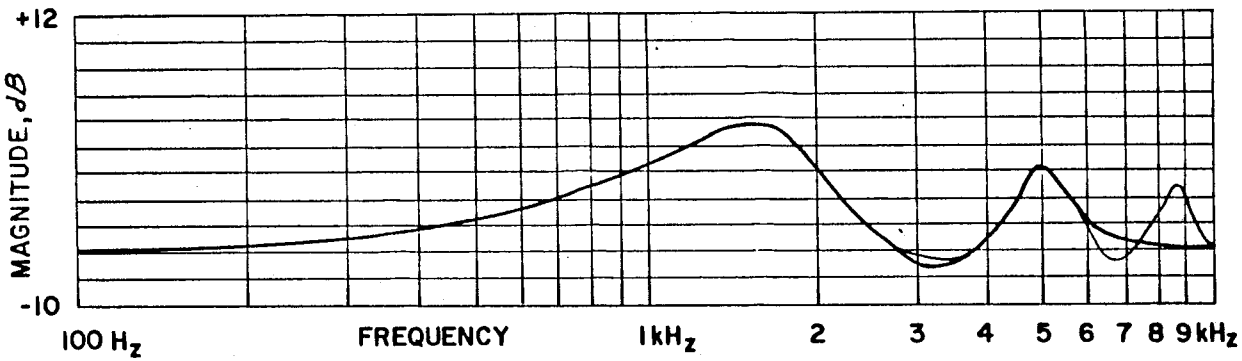

FIG. 5C is a set of magnitude-(dB)-versus-frequency-(log scale) computer-generated response curves of the transfer characteristics of the Sigma filter shown in FIG. 1C, characteristics similar to those shown for the Sigma filter in FIG. 3A, showing in dashed line the diffraction-computation specifications, and in solid line the approximation thereto, with modifications, computed for the synthesis via a specific sequence of biquadratic filter elements, used in explaining the invention.

Figure 5D:
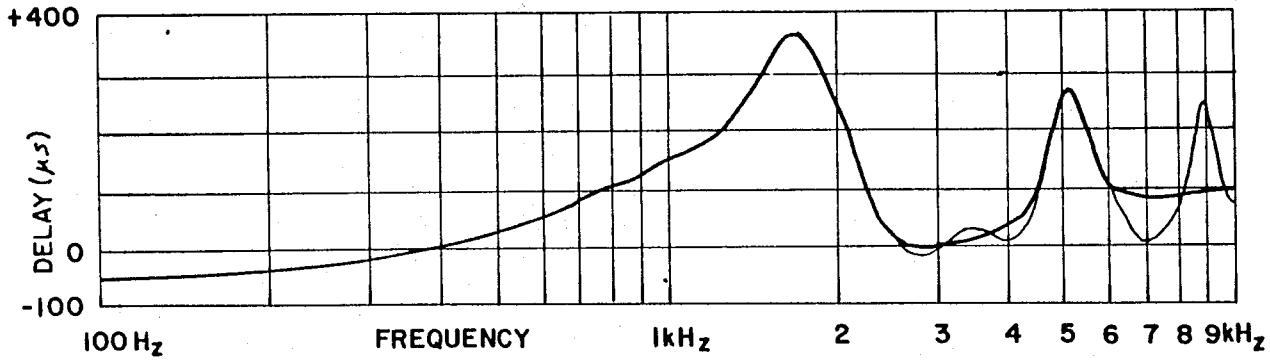

FIG. 5D is a set of delay-(vs)-versus-frequency-(log scale) computer-generated response curves of the transfer characteristics consequent to the magnitude characteristics of FIG. 5A, with a biquadratic synthesis curve shown in solid line, used in explaining the invention.

Figure 6:
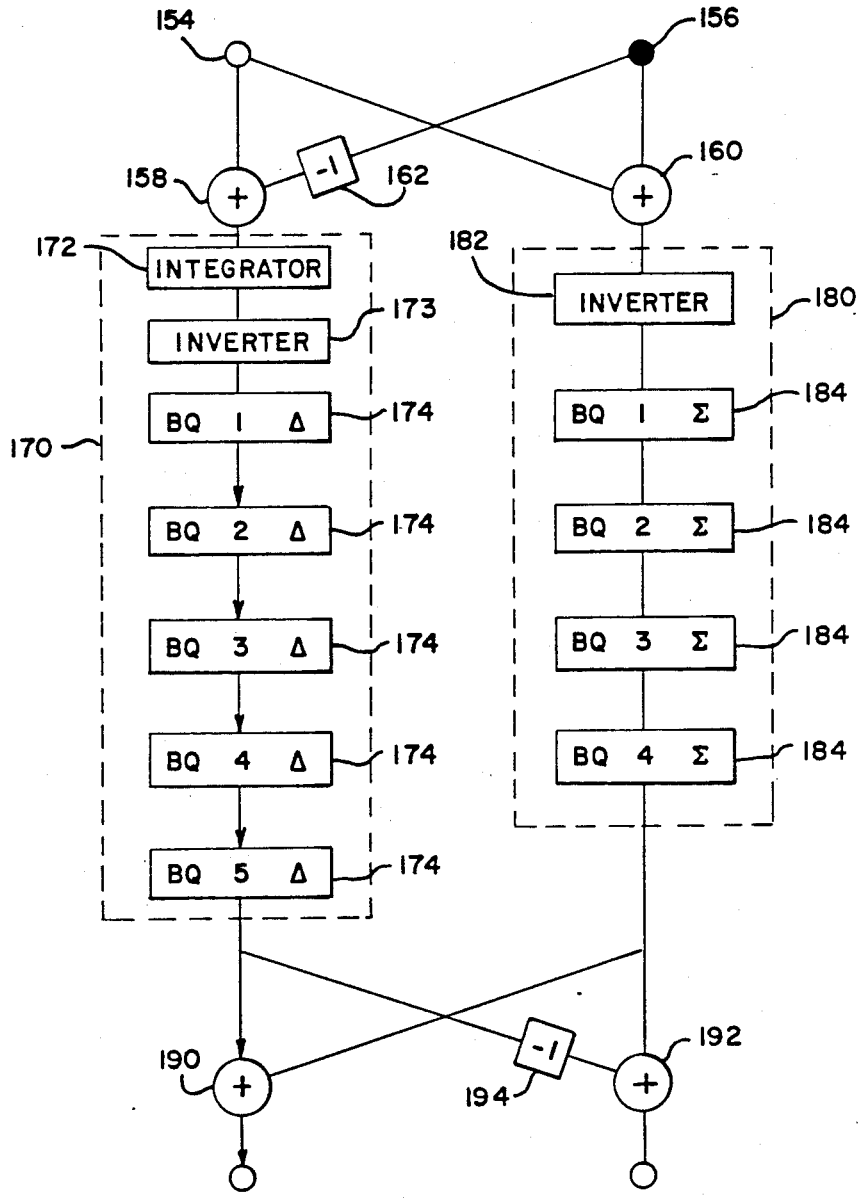

FIG. 6 is a block diagram of a specific embodiment of a circuit illustrating sequences of biquadratic filter elements to obtain the solid line curves of FIG. 6A through FIG. 6D in accordance with the invention.

Figure 7:
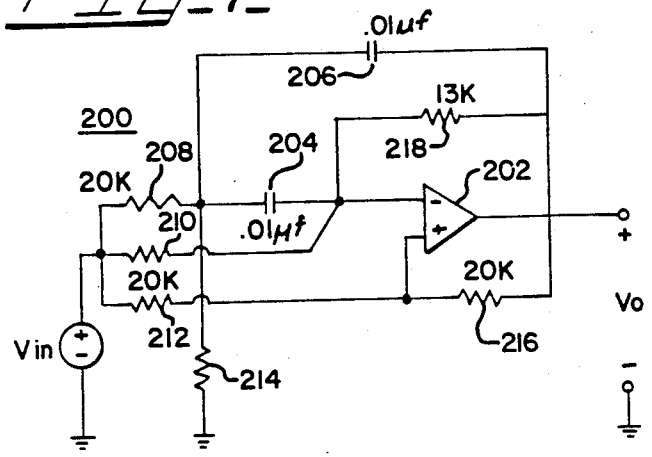

FIG. 7 is a schematic diagram illustrating a specific embodiment of a biquadratic filter element, in accordance with the invention.

FIG. 8 is a generalized block diagram illustrating a specific embodiment of a shuffler-circuit inverse formatter according to the invention to produce binaural earphone signals from signals intended for loudspeaker presentation.

Figure 8A:
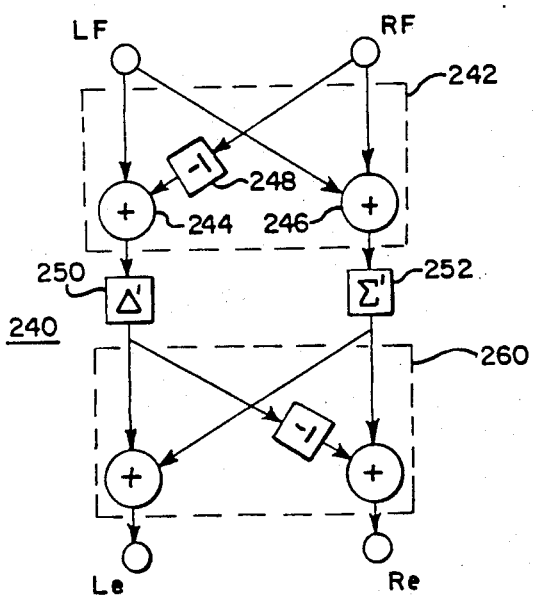

FIG. 8A is a generalized block diagram of the same embodiment illustrated in FIG. 8A, wherein the difference-sum forming networks are each represented as single blocks.

Figure 9:
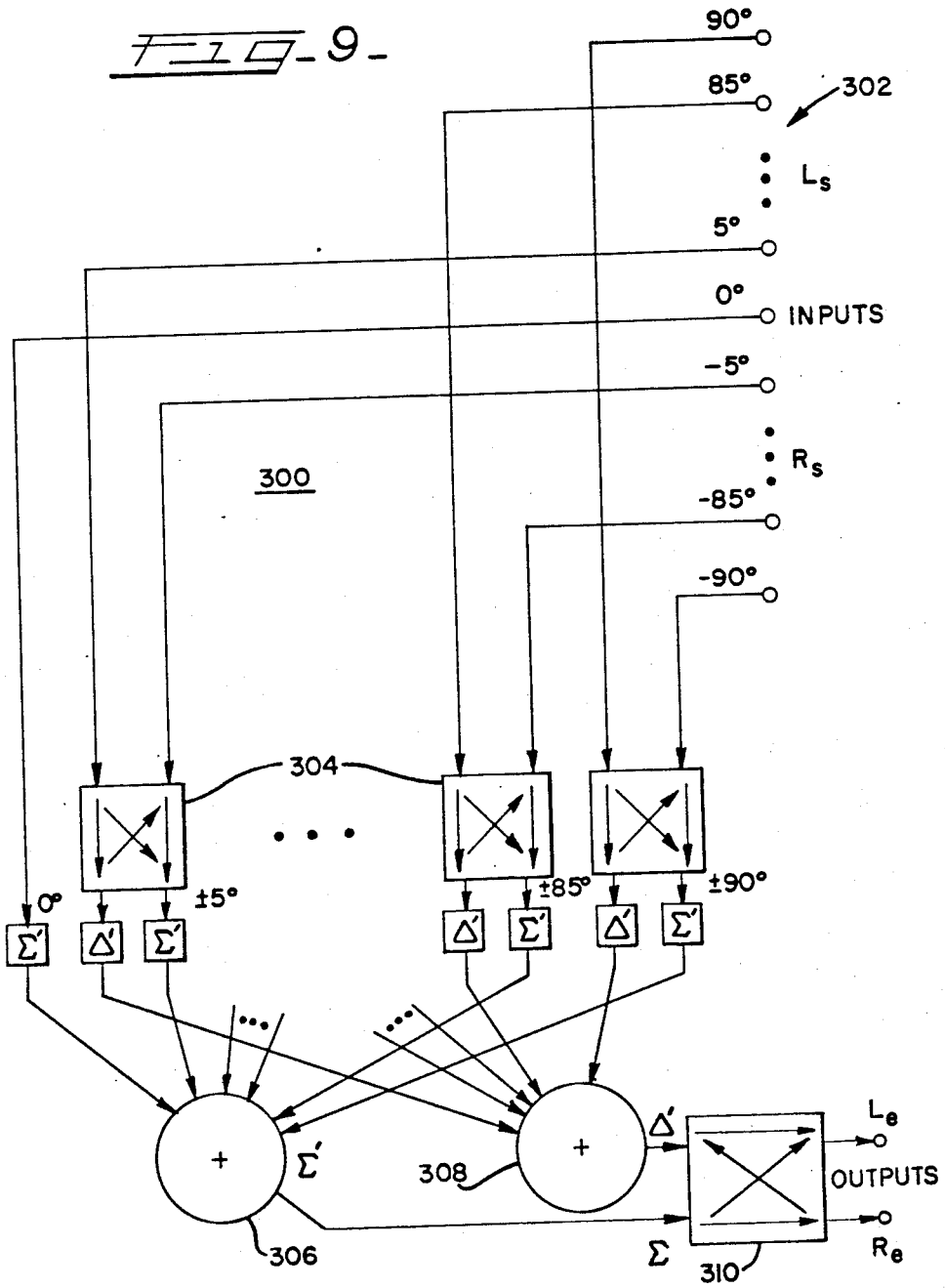

FIG. 9 is a generalized block diagram illustrating a specific embodiment of a multiple shuffle-circuit formatter functioning as a synthetic head.

FIG. 10A is a generalized block diagram illustrating a specific embodiment of a reformatted to convert signals intended for presentation at one speaker angle (e.g., ±30°) to signals suitable for presentation at another speaker angle (e.g., ±15°), employing two complete shuffle-circuit formatters.

FIG. 10B is a generalized block diagram illustrating a specific embodiment of a reformatted for the same purpose as in FIG. 10A, but using only one shuffle-circuit formatter.

FIG. 11 is a generalized block diagram illustrating a specific embodiment of a reformatted to convert signals intended for presentation via one loudspeaker layout to signals suitable for presentation via another layout, particularly one with an off-side listener closely placed with respect to one of the loudspeakers.

DETAILED DESCRIPTION OF PREFERRED EMBODIMENT

FIG 1A is a generalized block diagram illustrating a specific embodiment of a stereo audio processing system 50 according to the invention. The stereo system 50 comprises an artificial head 52 which produces two channels of audio signals which are coupled to a lattice network 54, as shown. The signals from the artificial head 52 may be coupled to the network 54 by first recording the signals and then reproducing them and coupling them to the network 54 at a later time. The artificial head 52 comprises a physical dummy head, which may be a spherical head in the illustrated embodiment, including appropriate microphones 64, 66. The artificial head may also be a replica of a typical human head using head dimensions representative of middle values for a large population. The output of the microphones 64, 66 provide audio signals having head-related transfer functions imposed thereon. The lattice network 54 provides crosstalk and naturalization compensation thereby processing the signals from the artificial head 52 to compensate for actual acoustical propagation path and head-related distortion.

The artificial head may alternately comprise a natural, living head whose ears have been fitted with miniature microphones, or it may alternately comprise a synthetic head. The synthetic head, to be described in detail at a later point in connection with FIG. 9, comprises an array of circuits simulating the signal modifying effects of head-related diffraction for a discrete set of source signals each designated a specific source bearing angle. The signals from such a head, or alternate, are each coupled to the network 54 which comprises filter circuits (S'G) 72, 74, crosstalk filters (A'F) 76, 78, and summing circuits 80, 82, configured as shown. The outputs of the network 54 are coupled to the loudspeakers 60 and 62, which are placed at a bearing angle $\phi$ (typically ±30°) for presentation to a listener 84, as shown. In one embodiment of the system 50' the summed signals at the summing circuits 80 and 82 may be recorded and then played back in a conventional manner to reproduce the processed audio signals through the loudspeakers 60 and 62.

Figure 1B:
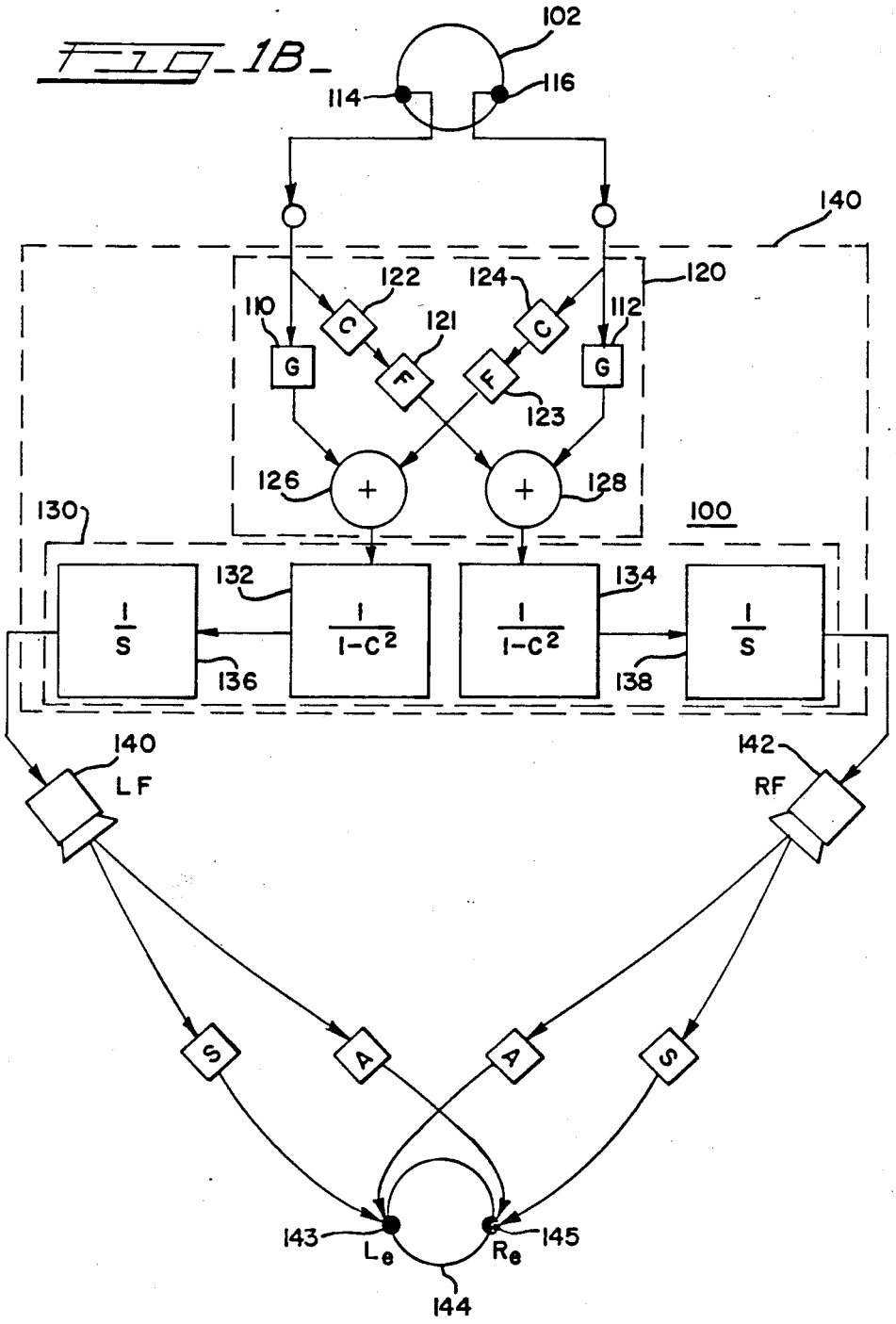
FIG. 1B is a generalized block diagram illustrating another specific embodiment of a stereo audio processing system according to the invention.

An alternative embodiment of a stereo audio processing system according to the invention is illustrated in generalized block diagram form in FIG. 1B. In the embodiment of FIG. 1B, the stereo audio processing system 100 comprises an artificial head 102 or alternative heads as indicated above in connection with FIG. 1A. The artificial head 102 is coupled, either directly or via a record/playback system to a compensation network 140 which comprises a crosstalk cancellation network 120 and a naturalizing network 130. The crosstalk cancellation network 120 comprises two crosstalk circuits 122 and 124 which impose a transfer function $C=-A/S$, where S is the transfer function for the acoustical propagation path characteristics from one loudspeaker to the ear on the same side, and A is the transfer function for the propagation path characteristics to the ear on the opposite side, as shown.

Each crosstalk circuit 122, 124 is substantially limited to frequencies substantially below ten kilohertz by low pass filters 121 and 123 with response characteristic F having cutoff frequency substantially below ten kilohertz. The output of the crosstalk filter circuits 121, 123 is summed with the output modified by the filters (G) 110, 112, by the summing circuits 126, 128, of the opposite channel, as shown. The resulting signals are coupled respectively to crosstalk correction circuits 132 and 134 which impose a transfer function of $1/(1-C^2)$. The resulting signals are coupled to the naturalization circuits 136 and 138 which impose a transfer function of 1/S, as shown. The output of the network 130 is then coupled, optionally via a recording/playback system, to a set of loudspeakers 140 and 142 for presentation to the ears 143, 145 of a listener 144, as shown.

FIG 1C is a generalized block diagram of another alternative embodiment of a stereo audio processing system according to the invention. The stereo audio processing system of FIG. 1C comprises an artificial head 151 comprising two microphones 152, 154 for generating two channels of audio signals having head-related transfer functions imposed thereon. A synthetic head, which is described in greater detail hereinafter with reference to FIG. 9, may alternatively be used. The audio signals from the artificial or synthetic head 151 are coupled, either directly or via a record/playback system, to a shuffler circuit 150, which provides crosstalk cancellation and naturalization of the audio signals.

The shuffler circuit 150 comprises a direct crosstalk channel 155 and an inverted crosstalk channel 156 which are coupled to a left summing circuit 158 and a right summing circuit 160, as shown. The left summing circuit 158 sums together the direct left-channel audio signal and the inverted crosstalk signal coupled thereto, and couples the resulting sum to a Delta (Δ) filter 162. The right summing circuit 160 sums the direct right-channel signal and the direct crosstalk left channel signal and couples the resulting sum to a Sigma (Σ) filter 164. The output of the Delta filter 162 is coupled directly to a left summing circuit 166 and an inverted output is coupled to a right summing circuit 170, as shown. The output of the Sigma filter 164 is coupled directly to each of the summing circuits 166 and 170, as shown. The output of the summing circuits 166 and 170 is coupled, optionally via a record/playback system to a set of loudspeakers 172 and 174 arranged with a preselected bearing angle $\phi$ for presentation to the listener 176.

Each of the three alternative embodiments may be shown to be equivalent. For the purposes of explaining the overall functioning of these configurations, let the filters F and G of FIGS. 1A and 1B be regarded as nonfunctioning, i.e., to have a frequency-independent transmission function of unity. (The purpose and design of these filters or alternative equivalents will be described in detail hereinafter). Then, if the transfer function through the direct path (through G) in FIG. 1B is computed, it is found to be $(1/S)/(1-C^2)$, equivalent to $S'=S/(S^2-A^2)$, to obtain a loudspeaker signal. Similarly, if the transfer function through the cross path (through F) is computed it is found to be $(C/S)(1-C^2)$, equivalent to $A'=-A/(S^2-A^2)$, to obtain a loudspeaker signal. These S' and A' transfer functions are the same functions used in FIG. 1A, and the same result would have been obtained if the F and G symbols had been carried along in the computation. The equivalence may be extended to FIG. 1C by requiring the Delta filter to be equal to $(S'-A')/2$ and requiring the Sigma filter to be equal to $(S'+A')/2$, which are $(\frac{1}{2})/(S-A)$ and $(\frac{1}{2})/(B+A)$ respectively, and there is little difficulty in carrying the F and G symbols through the derivation also $\frac{1}{2}$ may be omitted in these equations, neglecting 6 db uniform level shift, permitting for the purposes of analysis, the delta filter characteristic to be written as $1/(S-A)$, and the sigma filter characteristic to be written $1/(S+A)$.

Thus, an explanation of the functioning of any one of these embodiments will illustrate the functioning of them all. Referring to FIG. 1B, for example, where the acoustic-path transfer functions A and S are explicitly shown, it may be seen that the left ear signal at $L_e$ 143 is derived from the signal at the microphone 114 via the transfer function $S^2/(S^2-A^2)$ involving path S, to which must be added the transfer function $-A^2/(S^2-A^2)$ involving path A, with the result that the transfer function has equal numerator and denominator and is thus unity. However, a corresponding analysis shows that the transfer function from the signal at the microphone 116 to the same ear, $L_e$ 143 is $AS/(S^2-A^2)$ to which must be added $-AS/(S^2-A^2)$, thus obtaining a null transfer function. This analysis illustrates crosstalk cancellation whereby each ear receives only the signal intended for it despite its being able to hear both loudspeakers.

The embodiment of FIG. 1B, except for the F and G filters, was described by M.R. Schroeder in the American Journal of Physics, vol. 41, pp. 461–471 (Apr. 1973), "Computer Models for Concert Hall Acoustics," FIG. 4, and later in the Proceedings of the IEEE, vol. 63, p. 1332–1350 (Sept., 1975) "Models of Hearing," FIG. 4. Earlier equivalent versions may also be seen in B.S. Atal and M. R. Schroeder, "Apparent Sound Source Translator," U.S. Pat. No. 3,236,949 (Feb. 26, 1966).

However, the embodiment of FIG. 1B will be inoperative if the various filter functions specified therein cannot be realized as actual signal processors. The question of realizability may be examined with the help of FIG. 2A and FIG. 2B, plots of the acoustic transfer functions S and A in magnitude and phase, respectively, for a spherical-model head. Plots for a more realistic model will differ from these only in details not relevant to realizability. Schroeder taught that the filter $C=-A/S$ would be realizable, having a magnitude sloping steeply downward with increasing frequency, and similarly for the phase, indicating a substantial delay. The corresponding finite impulse response calculated by Fourier methods would show a characteristic pulse shape substantially delayed from the time of application of the impulse. The fulfillment of this causality condition is of the essence of realizability. Such an impulse response may be realized as a transversal filter. Schroeder saw that the filter $C^2$ would also be realizable as a transversal filter, and that placement of $C^2$ in a feedback loop would produce the realization of $1/(1-C^2)$. The remaining filter, 1/S, however, would not be directly realizable because Schroeder's data, contrary to FIG. 2B, showed 1/S to exhibit a rising phase response being indicative of an advance, with calculation by Fourier methods showing a characteristic pulse response beginning prior to the application of the impulse. Nevertheless, it was realized that providing a frequency-independent delay that would be equal in the two loudspeaker channels would be harmless, so that a transversal-filter realization employing augmented delay would be satisfactory for 1/S.

The filter S' and A' of FIG. 1A have the transfer functions shown plotted in FIG. 2C for magnitude and in FIG. 2D for phase, from spherical-model calculations. Specific curves for S' and A' are represented by the solid-line curves with dashed-line continuation, while the solid line continuations show modifications imposed by the filter factor G, forming S'G, and imposed by the filter factor F forming A'F, the filters shown in FIG. 1A. However, the corresponding phase modifications are not shown in FIG. 2D, such further information not being required at this point.

It may be seen from these unmodified curves that the S' and A' filters are realizable because of the steep downward slopes with increasing frequency in the phase, indicating abundant delay to allow realization by transversal filters. Of course, if more delay were needed for that purpose, it would be harmless to provide equal increments in delay for each. In the configuration used by Schroeder and Atal, the filters to be realized are more nearly directly related to measurable data, S and A, and one may always proceed with the greater confidence the closer one stays to measured data in its original form. Nevertheless, the requisite filters are realizable, so that FIGS. 1A and 1B show equally acceptable configurations.

The rather large amounts of delay involved in the filters for both of the configurations of FIG. 1A and FIG. 1B, however, make them awkward for realization by means other than transversal filters or other devices capable of generating longer delays. Other means of realization, or synthesis, are much less troublesome and expensive if the filters to be synthesized are of the kind known as "minimum phase" because then simpler network structures may be used with efficient, more widely-known synthesis techniques. Minimum-phase filters have the property that the phase response may be calculated directly from the logarithm of the magnitude of the transfer function by a method known as the Hilbert transform. If the transfer function is not of minimum phase, the calculation results in only a part of the phase response, leaving an excess part that is the phase response of an all-pass factor in the transfer function. Although many examples of all-pass filters are known, the synthesis of the phase response of an arbitrarily-specified all-pass filter is not as well developed an art as the synthesis of minimum-phase filters.

It is known in the art that the excess phase in the transfer functions A and S is nothing more than a frequency-independent delay (or advance). Thus, the Schroeder filters C and 1/S could have been realized as minimum-phase filters together with a certain frequency-independent increment in delay, since products and ratios of minimum-phase transfer functions are also of minimum phase. However, it does not follow that $1-C^2$ would be of minimum phase. Thus, the phase status of A' and S' does not follow. The difference between two properly-chosen, minimum-phase transfer functions is one means of synthesizing an all-pass transfer function.

However, it is one aspect of the invention to teach the use of minimum-phase filter synthesis in these systems. The inventors have been able to show that the transfer functions S+A and S−A have a common excess phase that is nothing more than a frequency-independent delay (or advance). Since the product of these is $S^2-A^2$, all of the filters considered thus far may be synthesized as minimum-phase filters, together with appropriate increments in frequency-independent delay. This provides a distinct advantage since such augmentation is available through well-known means.

It is a further aspect of the invention to teach limiting the frequency response of the crosstalk cancelling filters A' to form A'F. The modification shown as the solid-line continuation in FIG. 2C illustrates the general form of such modifications delegated to the filter function F. The reason for limiting frequency response is that cancellation actually takes place at the listener's ears and it is reasonably exact in a region of space near each ear, a region that is smaller for the shorter wavelengths. Thus, if the listener should turn his head, his ear will be less seriously transported out of the region of nearly exact cancellation if the cancellation is limited to the longer wavelengths. Schroeder reports some 10° as the maximum allowable rotation, and some 6 inches as the maximum allowable sideways movement for his system. It is a teaching of this invention that limiting the response of the crosstalk cancelling filter to a frequency substantially below 10 KHz will still allow accurate image portrayal over a wide enough frequency band to be quite gratifying while allowing the listener to move over comfortable ranges without risking serious impairment of the illusion. Experiments with an embodiment of the system illustrated in FIG. 1C confirm the correctness of this teaching.

The solid-line extension for curve S' in FIG. 2C illustrates one possible effect to be produced by the filter G of FIG. IA and FIG. 1B. When the acoustic transfer functions are determined from the spherical model of the head, as used here for illustration, then the undulations determined for S' will not be the same as they would be for a more realistic model, especially at the higher frequencies. In accordance with the invention, the filter will not simulate the details of these undulations above a certain frequency. However, there is another reason not to simulate the higher-frequency undulations: listeners' heads will vary in ways that are particularly noticeable in measurements at the higher frequencies, especially in the response functions attributed to the pinna. Thus, above a certain frequency, it would not be possible to represent these undulations correctly, except for a custom-designed system for a single listener. A correct simulation of these undulations will, however, affect only the tone quality at these higher frequencies, frequencies for which tee notion of "tone" becomes meaningless. It is sufficient to obtain the correct average high-frequency level, and dispense with detail. The solid-line extension of S' in FIG. 2C illustrates filter characteristics for one embodiment of the invention, and is characteristic of a system, as illustrated in FIG. 1C, which the inventors have constructed and with which they have made listening tests.

It is therefore to be seen that there are two reasons for limiting the crosstalk cancellation to frequency ranges substantially less than 10 kHz. The first reason is to allow a greater amount of listener head motion. The second reason is a recognition of the fact that different listeners have different head-shape and pinna (i.e., small-scale features), which manifest themselves as differences in the higher-frequency portions of their respective head-related transfer functions, and so it is desirable to realize an average response in this region.

Plots of the magnitude of the transfer functions Delta of FIG. 1C, namely 1/(S−A), and of Sigma, namely 1/(S+A), are shown in solid line in FIG. 3A. There, the dashed-line continuation shows the transfer function specified in terms of S and A in full for the spherical model of a head, and the solid-line shows the transfer function approximated in the system of FIG. 1C. The consequence of the modification illustrated in FIG. 3A is, in fact, the modification illustrated in FIG. 2C. The means whereby these transfer functions were realized will be discussed at a later point. It is seen that the modification in FIG. 3A consists in requiring a premature return to the high-frequency asymptotic level (−6 dB), premature in the sense of being completed as soon as possible, considering economies in realization, above about 5 KHz.

The curve Delta in FIG. 3A shows an integration characteristic, a −20 dB-per-decade slope that would intercept the −6 dB asymptotic level at about 800 Hz, with a beginning transition to asymptotic level that is modified by the insertion of a small dip near 800 Hz, and a similar dip near 1.8 KHz, after which there begins a relatively narrow peak characteristic at about 3.3 KHz rising some 7 dB above asymptotic, falling steeply back to asymptotic by about 4.5 KHz, followed by a small dip near 5 KHz, after which there is a rapid leveling out (solid-line continuation), at higher frequencies towards the asymptotic level. The curve Sigma in FIG. 3A shows a level characteristic at low frequencies that lies at the asymptotic level, followed by a gradual increase that reaches a substantial level (some 4 dB) above asymptotic by 800 Hz and continues to a peak at about 1.6 KHz at some 9.5 dB above asymptotic, after which there is a steep decline to asymptotic level at about 2.5 KHz, a small dip at about 3.5 KHz, followed by a narrow peak of some 6 dB at about 5.0 KHz, followed by a relatively steep decline to reach asymptotic level at about 6.3 KHz that is modified (solid-line continuation), beginning at about 6.0 KHz, to begin a rapid leveling out to the asymptotic level at higher frequencies.

The system of FIG. 1C also included a high-pass modification of these curves at extreme low frequencies, primarily to define a low-frequency limit for the integration characteristics of the Delta curve. The same high-pass characteristic is used for Sigma also, for the sake of equal phase fidelity between the two curves. Although a 35-Hz high-pass corner was chosen, in common, any in the range of approximately 10 Hz to 50 Hz would be very nearly equally satisfactory.

It is a teaching of this invention that these curves may be modified to approximate Delta and Sigma in a variety of ways, described below as alternative treatments of specifications of F and G for specific purposes. It is to be understood, however, that other modifications that result in curves following generalized approximations to the curves of FIG. 3A, or any of the frequency trends, whether for the spherical-model head, or replica of a typical human head, or any other model, and including consequences of such generalized approximations for the filters of FIG. 1A and FIG. 1B, fall within the teachings of this invention.

The curves shown in FIG. 3B illustrate means of obtaining an alternate G-filter effect mentioned above. It is seen that the solid-line extension for Delta is made to join with the solid-line curve for Sigma as soon as reasonable after 5 KHz, but that the Sigma curve is unmodified. Thus the difference between the two curves quickly approaches null, as shown in FIG. 3C by the trend in A'F towards minus infinity decibels. Thus F is as before, but it is also seen that S'G is the same as S', i.e., G is unity. As mentioned before, this alternative would be useful in custom-designed formatters.

Another alternative treatment of G is illustrated in FIG. 4A. There, the premature return to a high-frequency level is to a level some 2 dB higher than asymptotic. The result is an elevated high-frequency level for S'G, as illustrated in FIG. 4B, while A'F shows the same high-frequency termination as previously indicated.

Inspection of FIG. 4A suggests a lower frequency opportunity for premature termination to a high-frequency level, namely at about 2.5 KHz. By forcing the Delta and Sigma curves to follow the same function above such frequency, the cut-off frequency for low-pass filter F will, in effect, be determined to lie at about 2.5 KHz, while the character of G will be determined by the alternative chosen for the character of the common function to be followed above 2.5 KHz. Restriction of the crosstalk cancellation to such low frequencies will make the imaging properties more robust (i.e., being less vulnerable to listener movement). The price to be paid for such augmented robustness is, of course, a diminishment inmaging authenticity.

However, a more general means to limit the frequency range of crosstalk cancelling, one more general than the ad hoc process of looking for a propitious opportunity indicated by the curve shapes is illustrated in FIG. 4C. Indicated in FIG. 4C as a solid line is an approximation departing from the full specification, departures covering a broad range of frequencies, beginning with small departures at the lower frequencies, undertaking progressively larger departures at higher frequencies. Useful formatters may be constructed by such means, useful particularly to provide a more pleasing experience for badly-placed listeners that might thus perceive an untoward emphasis upon certain frequencies.

The specific filter responses used in constructing a test system as shown in FIG. 1C are illustrated in FIGS. 5A through 5D. These FIGS. 5A–5D show computer-generated plots of the spherical-model diffraction specifications in dashed line and plots of the accepted approximations in solid line. A computer was programmed to make the diffraction calculations and form the dashed line plot. However, it was also programmed to calculate the frequency response of the combination of filter elements to be constructed in realizing the filters and in making the solid-line plots. Then, the operator adjusted the circuit parameters of the filter elements to obtain close agreement with the diffraction calculations up to about 5 KHz. The filter thus designed was chosen to be a minimum-phase type. It was found that it is possible to obtain a simultaneous match for both the amplitude and the phase response except for an excess phase corresponding to nothing more than a frequency-independent delay (or advance). Since filters $1/(S-A)$ and $1/(S+A)$ were being approximated, these were thus established as of minimum phase, at least over the frequency range explored.

FIG. 5A illustrates the extent of agreement between diffraction specification and accepted design for the magnitude of Delta, plotted in decibels versus frequency (log scale), and FIG. 5B illustrates the simultaneous agreement in phase. The latter is actually a plot of phase slope, or frequency-dependent delay in microseconds, versus the same frequency scale. Agreement in phase slope is at least equal in significance as agreement in phase, but is of advantage in sensing a disagreement in frequency-independent delay (or advance), and such uniform-with-frequency discrepancies were indeed found. Such discrepancies were found to be the same for both the Delta and Sigma filters and could thus be suppressed in the filter design. FIGS. 5C and 5D illustrate, respectively, curves similarly obtained for the Sigma filter.

FIG. 6 is a detailed block diagram illustrating a specific embodiment of the system of FIG. 1C. Operational amplifiers (op amps) of Texas Instruments type TL 074 (four amplifiers per integrated-circuit-chip package) were used throughout. The insertion of input, high-pass filters (35 Hz corner) is not shown. In FIG. 6, input signals are coupled from inputs 154, 156 to summing circuits 158, 160 and each input is cross coupled to the opposite summing circuit with the right input 156 coupled through an inverter 162, as shown. An integrator 172 is placed in a Delta chain 170 as required at low frequencies, while inverters 173, 182 are inserted in both Sigma and Delta chains 170, 180. In these chains, a signal-inversion (polarity reversal) process happens at several places, as is common in op-amp circuits, and the inverters may be bypassed, as needed, to correct for a mismatch of numbers of inversions. The signals from the inverters 173, 182 are coupled to a series of BQ circuits (Bi-quadratic filter elements, also known as biquads) 174 and 184. The resulting signals are thereafter coupled to output difference-and-sum forming circuits comprising summing circuits 190, 192 and an inverter 194.

As is generally known, biquads may be designed to produce a peak (alternative: dip) at a predetermined frequency, with a predetermined number of decibels for the peak (or dip), a predetermined percentage bandwidth for the breadth of the peak (or dip), and an asymptotic level of 0 dB at extreme frequencies, both high and low.

A specific embodiment of a suitable biquadratic filter element 200 is shown in FIG. 7. Other circuits for realizing substantially the same function are known in the art. The biquad circuit element 200 comprises an operational amplifier 202, two capacitors 204, 206 and six resistors 208, 210, 212, 214, 216, and 218 configured, as shown. With the circuit-element values shown, a peak at KHz, of 10 dB height, and a 3 dB bandwidth of 450 Hz will be characteristic of the specific embodiment shown. Design procedures for such filter elements are well known in the art. Digital biquadratic filters are also well known in the digital signal-processing art.

The stereo audio processing system of the invention provides a highly realistic and robust stereophonic sound including authentic sound source imaging, while reducing the excessive sensitivity to listener position of the prior art systems. In the prior art systems, such as Schroeder and Atal, in which head related transfer function compensation has been used, the entire audio spectrum (20 hertz to 20 kilohertz) was compensated and the compensation was made as completely accurate as possible. These systems produced good sound source imaging but the effect was not robust (i.e., if the listener moved or turned his head only slightly, the effect was lost). By limiting the compensation so that it is substantially reduced at frequencies above a selected frequency which is substantially below ten kilohertz, the sensitivity to the listener movement is reduced dramatically. For example, providing accurate compensation up to 6 kilohertz and then rolling off to effectively no compensation over the next few kilohertz can produce a highly authentic stereo reproduction, which is also maintained even if the listener turns or moves. Greater robustness can be achieved by rolling off at a lower frequency with some loss of authenticity, although the compensation must extend above approximately 600 hertz to obtain significant improvements over conventional stereo.

To obtain the binaural recordings to be processed, an accurate model of the human head fitted with carefully-made ear-canal microphones, in ears each with a realistic pinna may be used. Many of the realistic properties of the formatted stereo presentation are at least partially attributable to the use of an accurate artificial head including the perception of depth, images far to the side, even in back, the perception of image elevation and definition in imaging and the natural frequency equalization for each.

It may be also true that some subtler shortcomings in the stereo presentation may be attributable to the limitation in bandwidth for the crosstalk cancellation and to the deletion of detail in the high-frequency equalization. For example, imaging towards the sides and back seemed to depend upon cues that were more subtle in the presentation than in natural hearing, as was also the case with imaging in elevation, although a listener could hear these readily enough with practice. Many of the needed cues are known to be a consequence of directional waveform modifications above some 6 KHz, imposed by the pinna. It is significant that these cues survived the lack of any crosstalk cancellation or detailed equalization at such higher frequencies, a survival deriving from the depth of the shadowing by the head at such high frequencies so that such compensating means are less sorely needed.

The experience of dedicated "binauralists" is that almost any acoustical obstacle placed between 6-inch spaced microphones is of decided benefit. Such obstacles have ranged from flat baffles resembling table-tennis paddles, to cardboard boxes with microphones taped to the sides, to blocks of wood with microphones recessed in bored holes, to hat-merchant's manikins with microphones suspended near the ears. One may, of course, think of spheres and ovoids fitted with microphones. Each of these has been found, or would be supposed with justice, to be workable, depending upon the aspirations of the user. The professional recordist will, however, be more able to justify the cost of a carefully-made and carefully-fitted replica head and external ears. However, any error in matching the head to a specific listener is not serious, since most listeners adapt almost instantaneously to listening through "someone else's ears." If errors are to be tolerated, it is less serious if the errors tend toward the slightly oversize head with the slightly oversize pinnas, since these provide the more pronounced localization cues.

This head-accuracy question needs to be carefully weighed in designing formatters that involve simulating the effect of a head directly, as for the synthetic head to be described hereinafter. One approach is to use measured head functions for these formatters. Fortunately, the excess delay in (S−A) and (S+A), the needed functions, is that of a uniform-with-frequency delay (or advance). The measurements, for most purposes, need be only of the ear signal difference and of the ear-signal sum, for carefully-made replicas of a typical human head in an anechoic chamber, and for most purposes only the magnitudes of the frequency responses need be determined. This is fortunate, since the measurement of phase is much more tedious and vulnerable to error. Such phase measurements as might be advantageous in some applications, need be only of the excess phase, i.e., that of frequency-independent delay, against an established free-field reference.

An example of direct head simulation would be that of a formatter to accept signals in loudspeaker format with which to fashion signals in binaural format (i.e., an inverse formatter). FIG. 8A illustrates a specific embodiment of a head-simulation inverse formatter 240 including a difference-and-sum forming network 242 comprising summing circuits 244, 246 and an inverter 248 configured as shown. The difference and sum forming circuit 242 is coupled to Delta-prime filter 250 and a Sigma-prime filter 252, the primes indicating that the filter transfer functions are to be S−A and S+A, instead of their reciprocals. The outputs of the Delta-prime and Sigma-rime filters is coupled, as shown, to a second difference and sum circuit 260, as shown. The first appearance of an inverse formatter, or its equivalent may be found in Bauer, "Stereophonic Earphones and Binaural Loudspeakers," Jour. Acoust. Soc. Am., vol. 9. pp. 148–151 (Apr. 1961), using separate S and A functions in approximation, showing a low-pass cutoff in A above about 3 KHz, and necessarily using explicit delay functions. See also Bauer, U.S. Pat. No. 3,088,997. It is an object of this aspect of the invention to improve upon Bauer by providing a more accurate head simulation, eliminating the low-pass cut for A, and avoiding the explicit use of delay by employing the shuffler configuration with Delta-prime and Sigma-prime filters. The use of faithful realizations of actual measured functions provides a further improvement. Since crosstalk cancellation is not a goal, there is no need for any kind of bandwidth limitation.

An accurate head simulator in this form is suitable for use with walk-type portable players using earphones. The conversion of binaurally-made, loudspeaker-format recordings back to binaural is highly suitable for such portable players. Questions of cost naturally arise in considering a consumer product, and particularly economical realizations of the filters are desirable and may be achieved by resorting to some compromise regarding accuracy and specifically using spherical model functions.

Figure 8B:
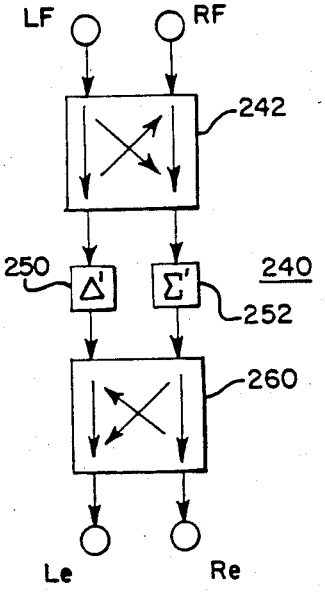

A block diagram of the inverse formatter 240 using an alternative symbol convention for the difference-and-sum-forming circuit is shown in FIG. 8B. Through the box symbol, the signal flow is exclusively from input to output. Arrows inside the box confirm this for those arrows for which there is no signal-polarity reversal, but a reversed arrow, rather than indicating reversed signal-flow direction, indicates, by convention, reversed signal polarity. Also by convention, the cross signals are summed with the direct signals at the outputs.

The above conventions are used, for compactness, in making the generalized block diagram of a specific embodiment of a synthetic head 300 illustrated in FIG. 9. A plurality of audio inputs or sources 302 (e.g., from directional microphones, a synthesizer, digital signal generator, etc.) are provided at the top right each being designated (i.e., assigned) for a specific bearing angle, here shown as varying by 5° increments from −90° to +90°, although other arrays are possible. Symmetrically-designated input pairs are then led to difference-and-sum-forming circuits 304, each having a Delta-prime output and a Sigma-prime output, as shown. Each Sigma-prime output is coupled to a respective Sigma-prime filter and each Delta-prime output is coupled to a Delta-prime filter, as shown. The Delta-prime outputs are summed, and the Sigma-prime outputs are summed, by summing circuits 306, 308, separately and the outputs are then passed to a difference-and-sum circuit 310 to provide ear-type signals (i.e., binaural signals). The treatment of the 0°-designated input is somewhat exceptional because it is not paired, and the Sigma-prime filter for it is $2S(0°)=S(0°)+A(0°)$, determined for 0°, and its output is summed with that of the other Sigmas. In the diagram, ellipses are used for groups of signal-processing channels that could not be specifically shown.

In the synthetic head 300, the Delta-prime and Sigma-prime filters may be determined by measurement for each of the bearing angles to be simulated, although for simple applications, the spherical-model functions will suffice. Economies are effected in the measurements by measuring only difference and sums of manikin ear signals and in magnitude only, as explained above. A refinement is achieved by the measurement of excess delay (or advance) relative to say, the 0° measurement. This latter data is used to insert delays, not shown in FIG. 9, to avoid distortions regarding perceptions in distance for the head simulation.

Head simulation and head compensation used together provide another aspect of the invention, a loudspeaker reformatted. A specific embodiment of a loudspeaker formatter 400 in accordance with the invention is illustrated in FIG. 10A. The loudspeaker reformatted processes input signals in two steps. The first step is head simulation to convert signals intended for a specific loudspeaker bearing angle, say ±30°, to binaural signals, which is performed by an inverse formatter 403 such as that shown in FIG. 8B. The processing in the second step is to format such signals for presentation at some other loudspeaker bearing angle, say ±15 by means for a binaural processing circuit 404 such as that shown in FIG. 1C. The two steps may, of course, be combined, as is illustrated in FIG. 10B. An application of such a reformatted may exist in television stereo wherein it is very difficult to mount loudspeakers in the television cabinet so that they would be placed at bearing angles so large as ±30 for a viewer.

Another aspect of the invention provides loudspeaker reformatting for nonsymmetrical loudspeaker placements such as might be found in an automobile wherein the occupants usually sit far to one side. A nonsymmetrical loudspeaker reformatted 500 in accordance with the invention is illustrated in FIG. 11. Compensation for the fact that the listener 512 is in unusual proximity to one loudspeaker 516 is accomplished by the insertion of delay 502, equalization 504 and level adjustment 506 for that loudspeaker. The delay and level adjustments are well known in the prior art. However, a loudspeaker reformatted 508 provides equalization adjustment from head diffraction data for the bearing angle of the virtual loudspeaker 520, shown in dashed symbol, relative to the uncompensated, other-side loudspeaker 514. While a very good impression of the recording is ordinarily possible for such off-side listeners improved results can be obtained with such reformatting. Switching facilities may be provided to make the reformatting available either to the driver, or to the passenger, or to provide symmetrical formatting.

A specific embodiment of the stereo audio processing system according to the invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. An audio processing system for generating compensated audio signals suitable for reproduction through a loudspeaker system, comprising:

source means for providing two channels of audio signals having head-related transfer functions imposed thereon;

compensation means for providing cross-talk cancellation of the audio signals and for providing naturalization compensation of the audio signals to correct for propagation path distortion including filtering means for substantially modifying frequency and phase response of the cross-talk cancellation and naturalization compensation at frequencies beginning at a frequency above 600 hertz and beginning at least at a frequency below ten kilohertz in such a way as to release the cross-talk cancellation at such high frequencies thereby generating compensated audio signals.

2. The audio processing system of claim 1 wherein the compensation means comprises means for substantially limiting the crosstalk cancellation and naturalization compensation to frequencies substantially below ten kilohertz.

3. The audio processing system of claim 1 comprising a synthetic head means for generating the two channels of audio signals and simulating the effects of head related diffraction.

4. The audio processing system of claim 3 wherein the synthetic head means comprises a plurality of signal sources each having a directional assignment.

5. The audio processing system of claim 4 wherein the synthetic head simulates a typical human head.

6. The audio processing system of claim 3 wherein the synthetic head means comprises a plurality of directionalized microphones and filter structures to simulate the effects of head diffraction.

7. The audio processing system of claim 4 wherein the synthetic head simulates spherical head diffraction effects.

8. The audio processing system of claim 1 wherein the compensation means is a shuffler structure utilizing minimum delay filters.

9. The audio processing system of claim 8 wherein the compensating means processes the audio signals such that the compensated audio signals are formatted for reproduction through loudspeakers placed at a predetermined speaker bearing angle.

10. The audio processing system of claim 2 wherein the source means provides stereo audio signals formatted for a predetermined speaker bearing angle and the compensation means comprises means for reformatting the audio signals for a different selected speaker bearing angle.

11. An audio processing system for processing audio signals to generate compensated audio signals suitable for reproduction through loudspeakers comprising:

source means for providing two channels of audio signals and for imposing effects of head related diffraction effects thereon; and processing means for processing the audio signals to cancel the effects of propagation from the loudspeakers to the ears of a listener, said processing substantially limited to frequencies substantially below ten kilohertz.

12. The audio processing system of claim 11 wherein the source means imposes diffraction effects of a replica of a typical human head.

13. The audio processing system of claim 11 wherein the processing means comprises filters having characteristics derived from a spherical head model.

14. The audio processing system of claim 11 wherein the processing means comprises a shuffler network comprising crosstalk cancellation, and minimum delay Sigma and Delta filters.

15. The audio processing system of claim 14 wherein the Sigma and Delta filter characteristics are derived from a spherical head model.

16. The audio processing system of claim 11 wherein the source means comprises a synthetic head using a plurality of signal sources and a filter array to simulate head diffraction effects.

17. A method for processing audio signals for reproduction through loudspeakers comprising the step of:

generating two channels of audio signals having head-related diffraction effects imposed thereon; and processing the audio signals to provide cross-talk cancellation for the effects of propagation from the loudspeakers to the ears of a listener and modifying the processing at high frequencies beginning at a frequency below ten kilohertz to reduce the cross-talk cancellation at such high frequencies to produce compensated audio signals.

18. The method of claim 17 further comprising the step of reproducing the compensated audio signals through loudspeakers.

19. The method of claim 17 wherein the step of processing comprises the step of compensating based upon an artificial head which is a replica of a typical human head.

20. The method of claim 17 wherein the step of generating comprises the step of generating each channel of audio signals by simulation of the head related diffraction effects utilizing a signal source and filter array.

* * * * *

UNITED STATES PATENT AND TRADEMARK OFFICE

CERTIFICATE OF CORRECTION

PATENT NO. : 4,893,342

DATED : January 9, 1990

INVENTOR(S) : Duane H. Cooper et al.

It is certified that error appears in the above-identified patent and that said Letters Patent is hereby corrected as shown below:

Column 1, line 32, "ague" should be --vague--.

Column 3, line 31, "reformatted" should be --reformatter--.

Column 4, line 55, "filter, elements" should be --filter elements--.

Column 4, line 59, "biquadratic synthesis" should be --biquadratic-synthesis--.

Column 5, line 15, "FIG. 8" should be --FIG. 8A--.

Column 5, line 20, "FIG. 8A" should be --FIG. 8B--.

Column 5, line 28, "reformatted" should be --reformatter--.

Column 5, line 34, "reformatted" should be --reformatter--.

Column 5, line 38, "reformatted" should be --reformatter--.

Column 6, line 14, "system 50'" should be --system 50,--.

Column 7, line 39 "and (1/2)/(B+A)" should be --(1/2)/(S+A)--.

Column 7, line 41, "also 1/2 may be omitted in these equations, neglecting 6 db" should be --also, the factor 1/2 may be omitted in these equations, neglecting a 6 dB--.

UNITED STATES PATENT AND TRADEMARK OFFICE

CERTIFICATE OF CORRECTION

PATENT NO. : 4,893,342

DATED : January 9, 1990

INVENTOR(S) : Duane H. Cooper et al.

It is certified that error appears in the above-identified patent and that said Letters Patent is hereby corrected as shown below:

Column 10, line 14 "for which tee notion" should be --for which the notion--.

Column 11, lines 19-20, "or any of the frequency trends" should be --or any of the curves thereafter, including approximations to the high-frequency trends".

Column 11, line 56, "a diminishment inmaging" should be --a diminishment in imaging--.

Column 13, lines 9-10, "a peak at KHz" should be --a peak at 1 KHz--.

Column 15, line 61, "reformatted." should be --reformatter.--.

Column 15, line 63, "reformatted" should be --reformatter--.

Column 16, line 6, "reformatted" should be --reformatter--.

Column 16, line 14, "reformatted" should be --reformatter--.

Column 16, line 21, "reformatted" should be --reformatter--.

Column 16, line 58, "at frequencies" should be --at high frequencies--.

UNITED STATES PATENT AND TRADEMARK OFFICE

CERTIFICATE OF CORRECTION

PATENT NO. : 4,893,342

DATED : January 9, 1990

INVENTOR(S) : Duane H. Cooper et al.

It is certified that error appears in the above-identified patent and that said Letters Patent is hereby corrected as shown below:

Column 16, line 61, "release" should be --reduce--.

Column 18, line 19, "step" should be --steps--.

Signed and Sealed this

Fourteenth Day of January, 1992

*Attest:*

*Attesting Officer*

HARRY F. MANBECK, JR.

*Commissioner of Patents and Trademarks*